US007290653B2

(12) United States Patent
Izen et al.

(10) Patent No.: US 7,290,653 B2
(45) Date of Patent: Nov. 6, 2007

(54) PACKAGED MUSICAL INSTRUMENT

(75) Inventors: Mark S. Izen, Chestnut Hill, MA (US); Alexander Webb, Wayland, MA (US); Michael Oppenheim, Abington, MA (US)

(73) Assignee: First Act Inc., Boston, MA (US)

( * ) Notice: Subject to any disclaimer, the term of this patent is extended or adjusted under 35 U.S.C. 154(b) by 360 days.

(21) Appl. No.: 10/930,615

(22) Filed: Aug. 31, 2004

(65) Prior Publication Data

US 2006/0042975 A1 Mar. 2, 2006

(51) Int. Cl.
*A45C 11/00* (2006.01)

(52) U.S. Cl. ..... 206/314; 206/782

(58) Field of Classification Search ..... 229/104, 229/112, 125.19; 206/14, 314, 776, 782
See application file for complete search history.

(56) References Cited

U.S. PATENT DOCUMENTS 6,283,287 B1 * 9/2001 Carl ..... 206/314
6,612,483 B2 * 9/2003 Harris et al. ..... 229/104
6,670,536 B2 * 12/2003 Godin et al. ..... 84/453
2003/0192795 A1 * 10/2003 Izen et al. ..... 206/314
2004/0154940 A1 * 8/2004 Minakuchi ..... 206/314
2004/0217026 A1 * 11/2004 Neilson ..... 206/314

* cited by examiner

*Primary Examiner*—David T. Fidei
(74) *Attorney, Agent, or Firm*—John E. Toupal; Harold G. Jarcho

(57) ABSTRACT

A packaged musical instrument including a carton having a top wall, a bottom wall, a first side wall, a second side wall, an upper side wall, and a lower side wall together defining an inner chamber; and a guitar disposed in the cavity and having a body, and a neck joined to the body and terminated with a tuning head portion. Also included is a first insert disposed in and restraining the body in the cavity and having one side wall engaging a lower portion of the first side wall, another side wall engaging a lower portion of the second side wall, and an end wall engaging the lower side wall; and cavity; a second insert disposed in the cavity and having one portion engaging an upper portion of the first side wall, another portion engaging an upper portion of the second side wall, and a cross member extending between the one portion and the another portion with the cross member being shaped and arranged to support the neck; and at least one window defined by the top wall and displaying at least a portion of the guitar.

13 Claims, 8 Drawing Sheets

PACKAGED MUSICAL INSTRUMENT

BACKGROUND OF THE INVENTION

The invention relates generally to packaged articles and, more particularly, to packaged musical instruments.

Boxes are widely used to transport, store and protect articles of various size and shape. For some applications, photographs of its contents are applied to outer surfaces of the boxes allowing them to be used as displays in a retail environment. Also, boxes are generally dimensioned according to its contents in the interest of conserving space and material. Accordingly, boxes assume a variety of sizes and shapes depending on the shape and contour of their contents. Some shapes result in boxes with instability which prevents their effective use as displays.

A box specifically intended for displaying a guitar is disclosed in U.S. Pat. No. 6,612,483. Although an improvement over prior packaging, the disclosed package does not prevent in all cases instrument handling damage and offers only a single display orientation.

The object of this invention, therefore, is to provide an improved packaged instrument that can be effectively used for the display and protection of the instrument.

SUMMARY OF THE INVENTION

The invention is a packaged musical instrument including a carton having a top wall, a bottom wall, a first side wall, a second side wall, an upper side wall, and a lower side wall together defining an inner chamber; and a guitar disposed in the cavity and having a body, and a neck joined to the body and terminated with a tuning head portion. Also included is a first insert disposed in and restraining the body in the cavity and having one side wall engaging a lower portion of the first side wall, another side wall engaging a lower portion of the second side wall, and an end wall engaging the lower side wall a second insert disposed in the cavity and having one portion engaging an upper portion of the first side wall, another portion engaging an upper portion of the second side wall, and a cross member extending between the one portion and the another portion with the cross member being shaped and arranged to support the neck; and at least one window defined by the top wall and displaying at least a portion of the guitar. The inserts fully protect the guitar and the top wall offers desirable display thereof.

According to one feature of the invention the carton includes a plurality of tabs projecting outwardly from the top wall and being shaped and arranged to support the carton in a tilted position with the top wall sloping rearwardly and the upper side wall above the lower side wall. This feature facilitates desirable display orientation of the guitar.

According to other features of the invention, the end wall engages a central portion of the lower side wall, and each of the one and another side walls include an angled section joined to the end wall and being shaped and arranged to engage a curved lower side portion of the body, and the cross member defines a saddle portion shaped and arranged to receive and support the neck. These features offer additional guitar protection.

According to yet another feature, the carton includes a fastener for restraining the neck in the saddle. Further protection is provided by the fastener.

According to further features, the one window displays at least a portion of the body, another window displays the tuning head portion of the neck, and the top wall defines a strip portion extending over the cross member and separating the one window from the another window. These features improve visual appearance of the guitar on display.

According to an additional feature, the carton includes flaps extending transversely downwardly from the top wall and engaging outer surfaces of the first and second side walls, the upper side wall and the lower side wall. This feature simplifies assembly of the finished packaged instrument.

According to an important feature, the invention includes a plurality of tabs projecting outwardly from the top wall and being shaped and arranged to support the carton in a tilted position with the top wall sloping rearwardly and the another side wall above the one side wall. This feature improves display versatility.

DESCRIPTION OF THE DRAWINGS

These and other objects and features of the invention will become more apparent upon a perusal of the following description taken in conjunction with the accompanying drawings wherein.

DESCRIPTION OF THE PREFERRED EMBODIMENT

Figure 1:
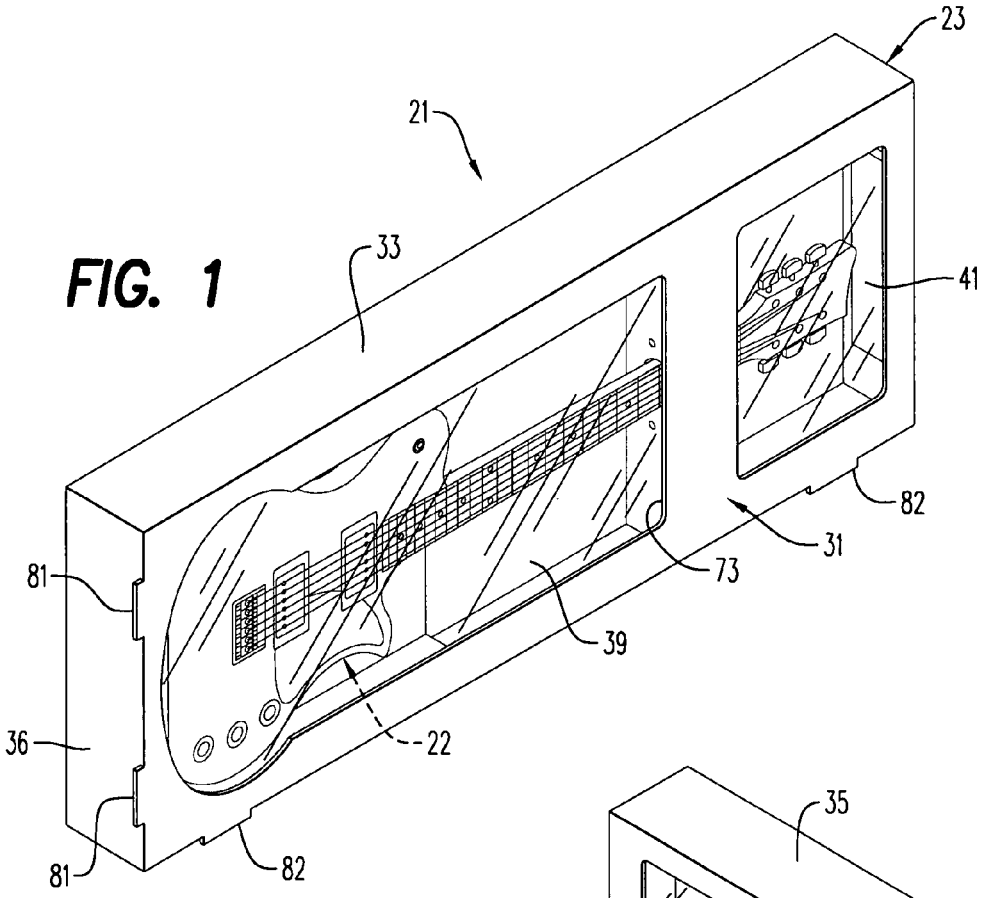
FIG. 1 is a front perspective view in a horizontal position of a packaged instrument according to the invention.
Figure 2:
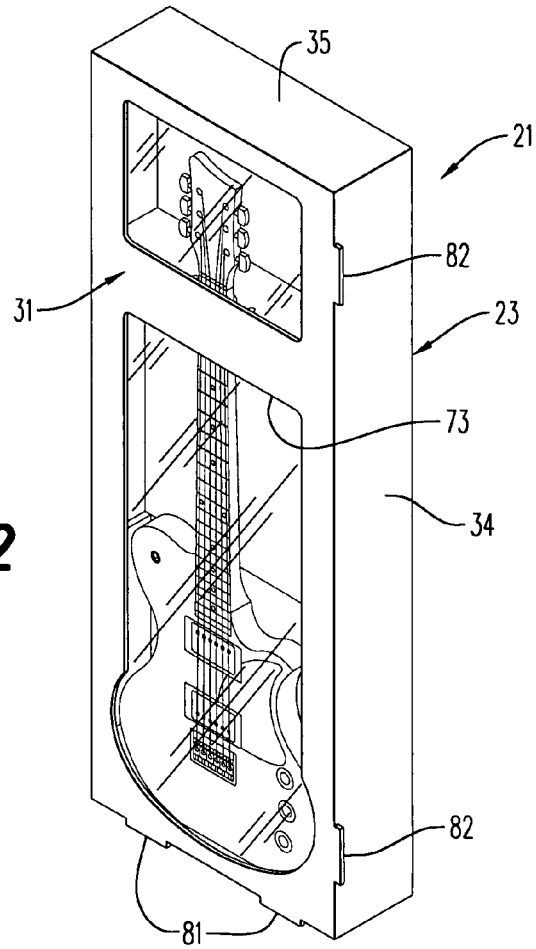
FIG. 2 is a front perspective view in a vertical position of the packaged instrument of FIG. 1.
Figure 3:
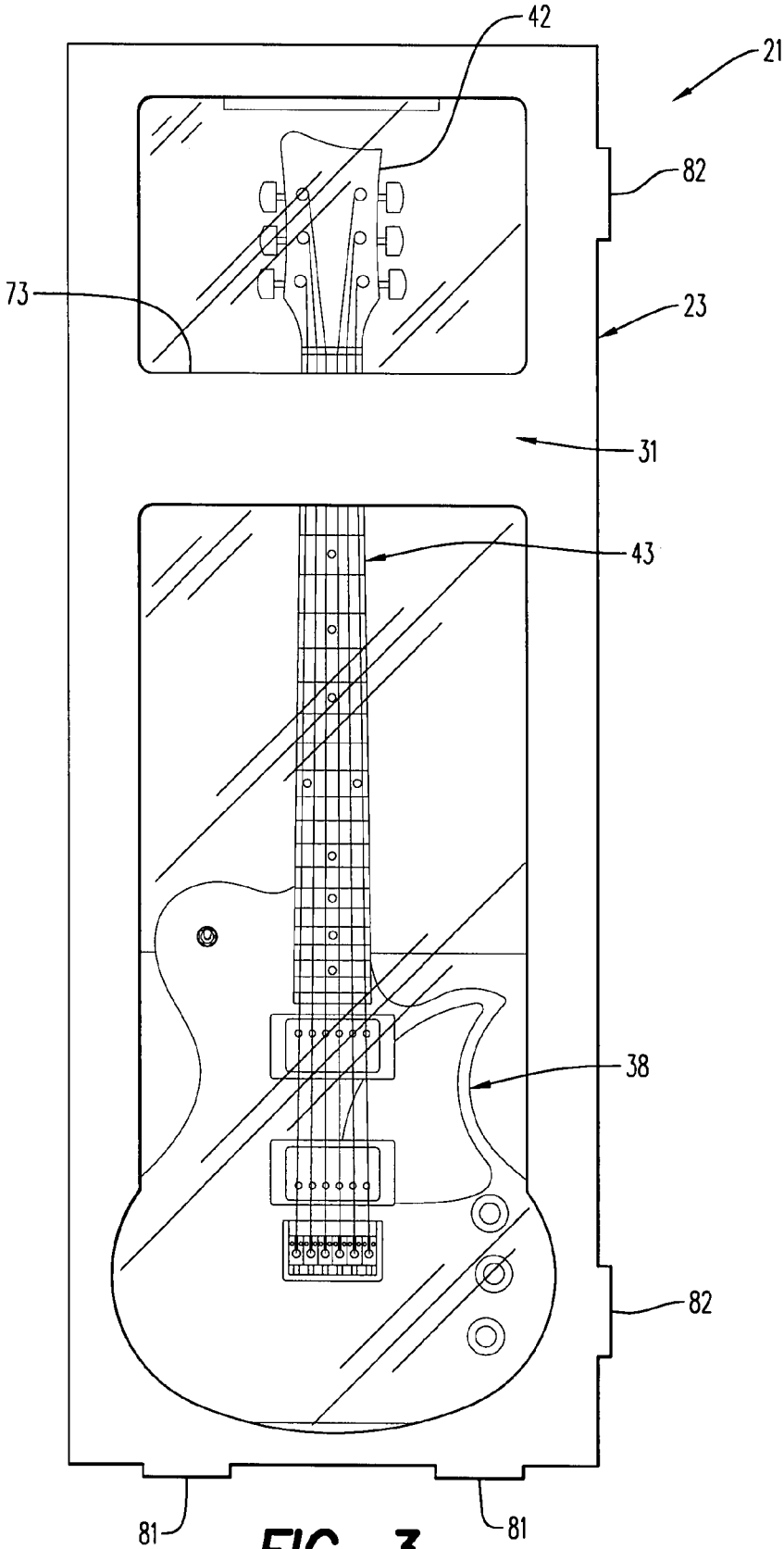
FIG. 3 is a front view of the packaged instrument shown in FIGS. 1 and 2.
Figure 4:
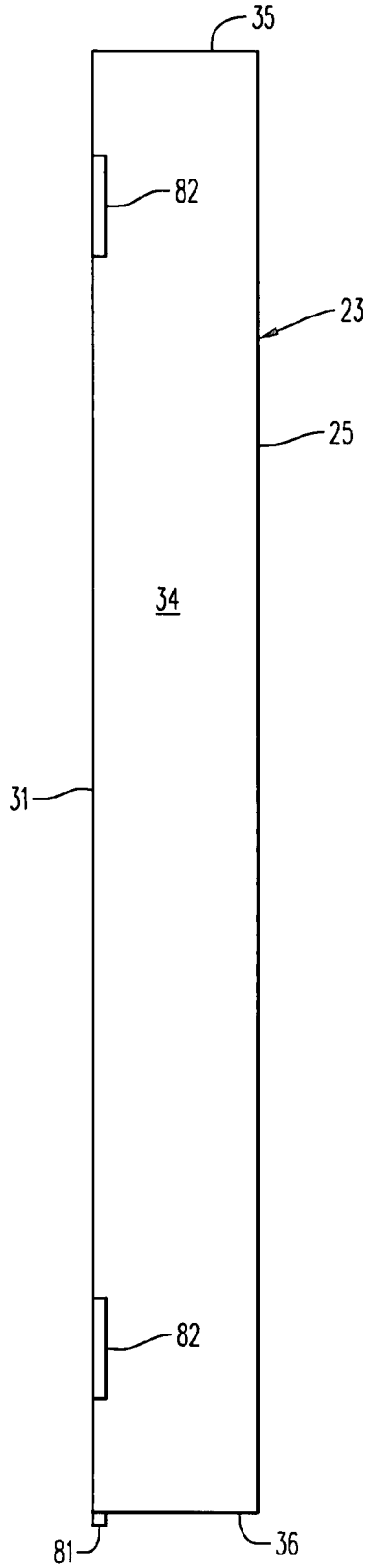
FIG. 4 is a right side view of the packaged instrument of FIGS. 1-3.
Figure 5:
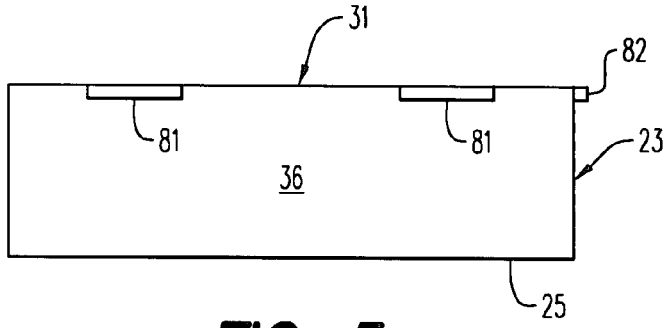
FIG. 5 is a bottom view of the packaged instrument of FIGS. 1-4.
Figure 6:
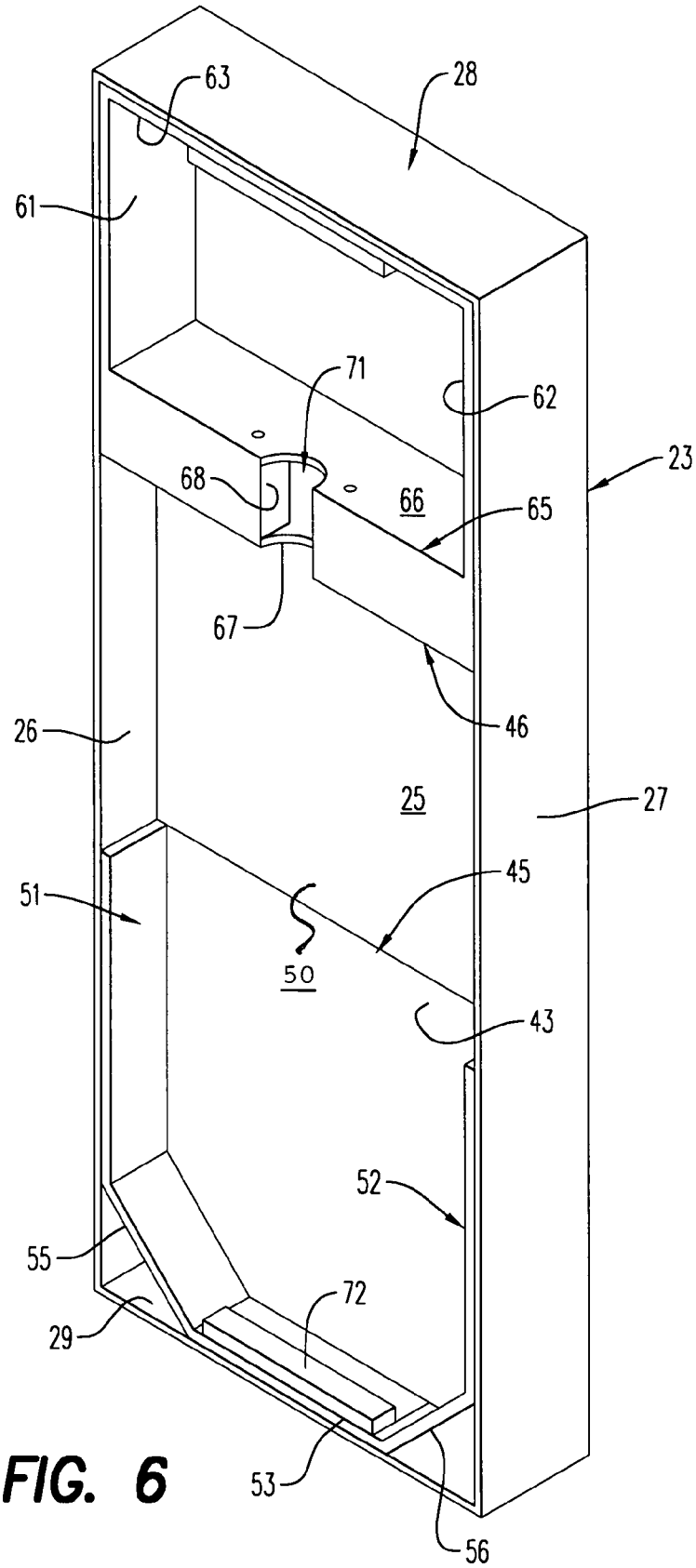
FIG. 6 is a front perspective view of a portion of a carton shown in FIGS. 1-5.
Figure 7:
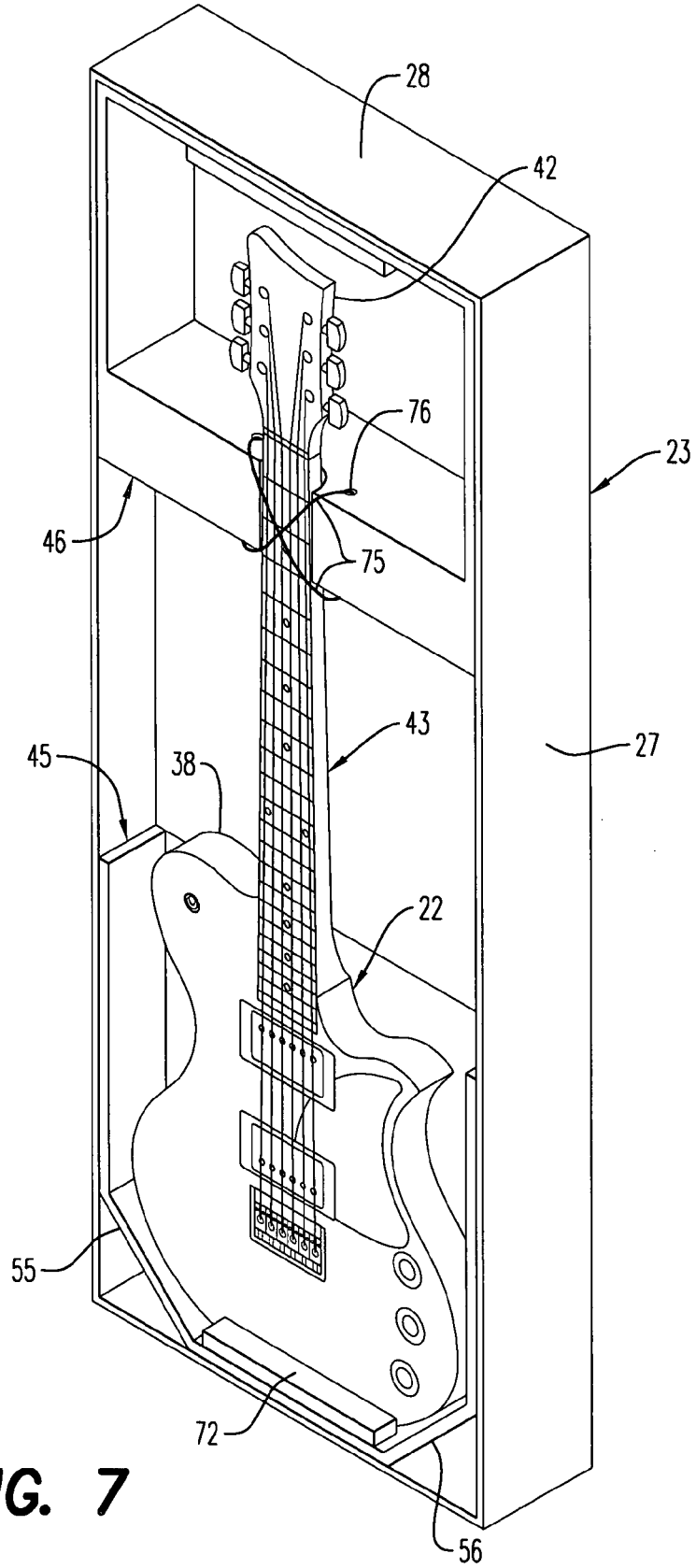
FIG. 7 is a front perspective view of the carton portion in FIG. 6 retaining a guitar.
Figure 8:
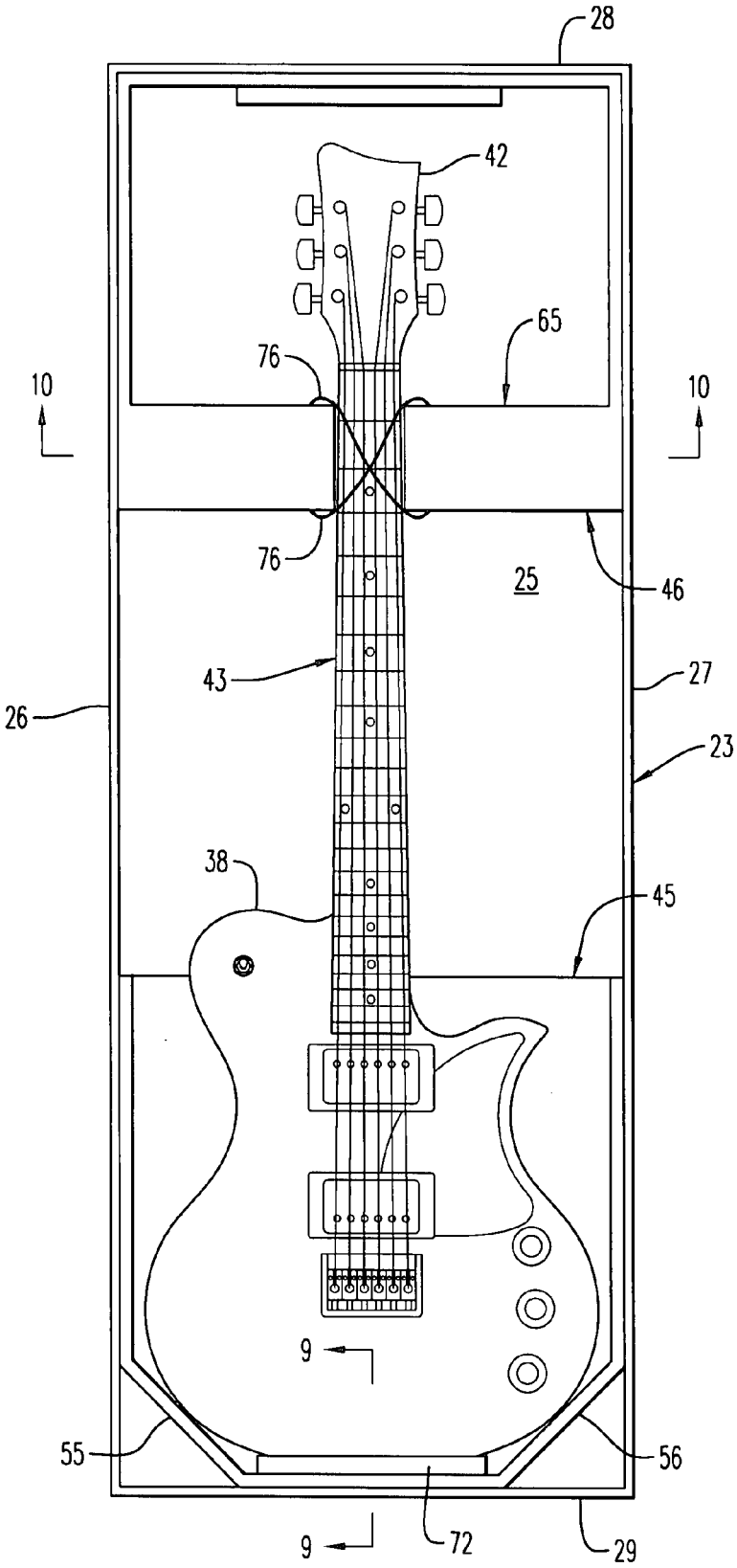
FIG. 8 is a front view corresponding to FIG. 7.
Figure 9:
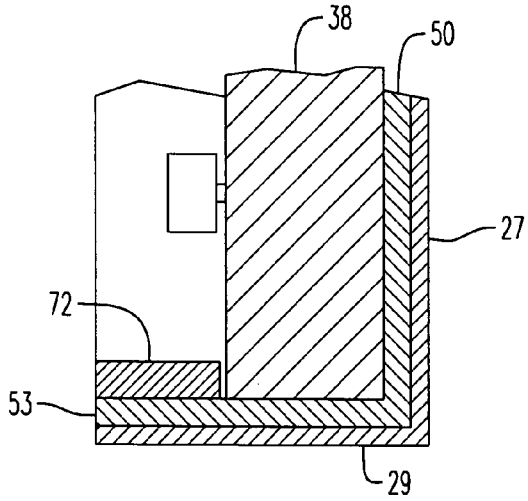
FIG. 9 is a partial cross-sectional view taken along lines 9-9 of FIG. 8.
Figure 10:
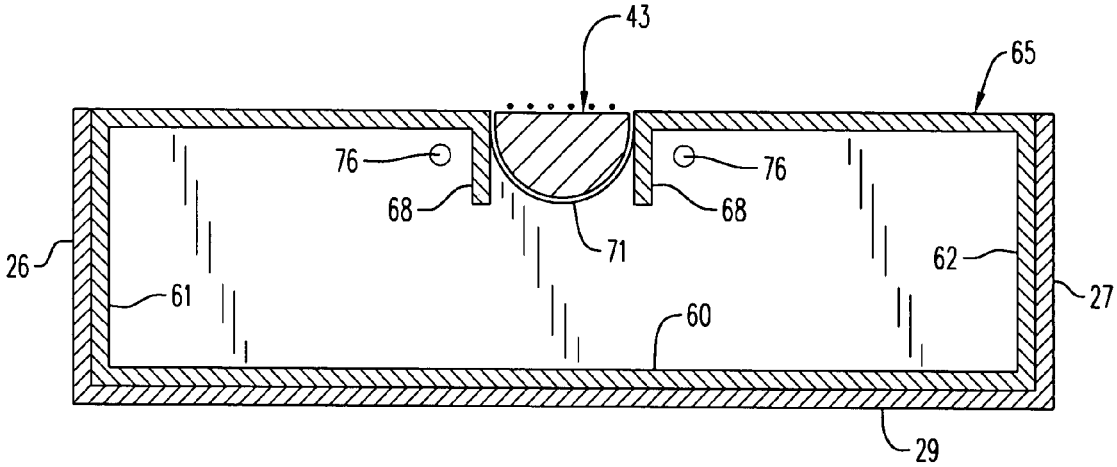
FIG. 10 is a cross-sectional view taken along lines 10-10 of FIG. 8.

A packaged musical instrument 21 includes a guitar 22 packed in a carton 23. As shown in FIGS. 6-8, the carton 23 has a bottom wall 25, first side wall 26, second side wall 27, upper side wall 28 and lower side wall 29. A top wall 31 of the carton 23 is shown in FIGS. 1-3. Extending downwardly from outer edges of the top wall 31 are flaps 33-36 which engaged outer surfaces of, respectively, the first, second, upper and lower side walls 26-29. The guitar 22 has a body 38 visible through one window 39 defined by the top wall 31. Another window 41 displays a tuning head portion 42 of a neck 43 extending from the body 38.

Retained within a cavity 43 formed within the carton 23 is a first insert 45 and a second insert 46 both illustrated in FIGS. 6-7. The first insert 45 is formed by a base wall 50 and extending upwardly therefrom one side wall 51 engaging a lower portion of the first side wall 26, another side wail 52 engaging a lower portion of the second side wall 27 and an end wall 53 engaging a middle portion of the lower side wall 29. Joining opposite ends of the end wall 53 to ends of, respectively, the side walls 51, 52 are angled sections 55, 56 thereof.

The second insert 46 is formed by a base wall 60 and extending upwardly from edges thereof one side wall portion 61 engaging an upper portion of the first side wall 26, another side wall portion 62 engaging an upper portion of the second side wall 27, an upper side wall portion 63 engaging the upper side wall 28 and a hollow cross member 65 having parallel side walls 66, 67 and joining the side walls 61, 62.

During packaging, the guitar 22 is inserted into the cavity 43 with the top wall 31 of the carton 23 removed (FIGS. 6-7). The bottom edge of the body 38 engages the end wall 53 while curved lower side portions of the body 38 engage, respectively, the angled sections 55, 56 of the side walls 51, 52. In addition, the neck 43 is received by a saddle portion 71 formed by arcuate cutouts in the side walls 66, 67 of the cross member 65. Straddling the saddle portion are flaps 68 (FIG. 6). The body 38 then is secured in position by a block 72 fixed to the end wall 53 and the neck 43 is secured in the saddle portion 71 by fastener ties 75 extending through bores 76 in the cross member 65. Finally, top wall 31 and attached flaps 33-36 are slid over the side walls 26-29 to cover the cavity 43. In its assembled position a strip portion 73 of the top wall 31 extends over the cross member 65 to more attractively display the guitar 22.

Figure 11:
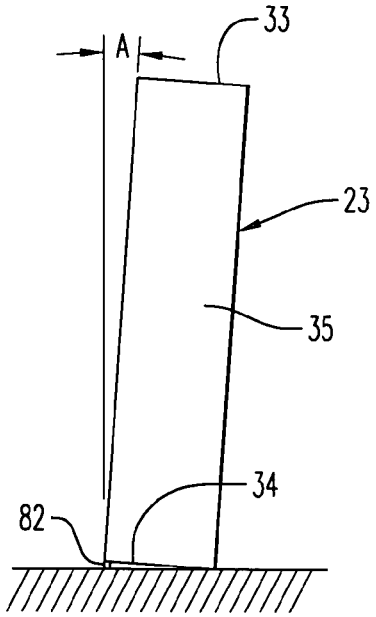
FIG. 11 is a side view of a horizontally upright position of the packaged instrument of FIGS. 1-3.
Figure 12:
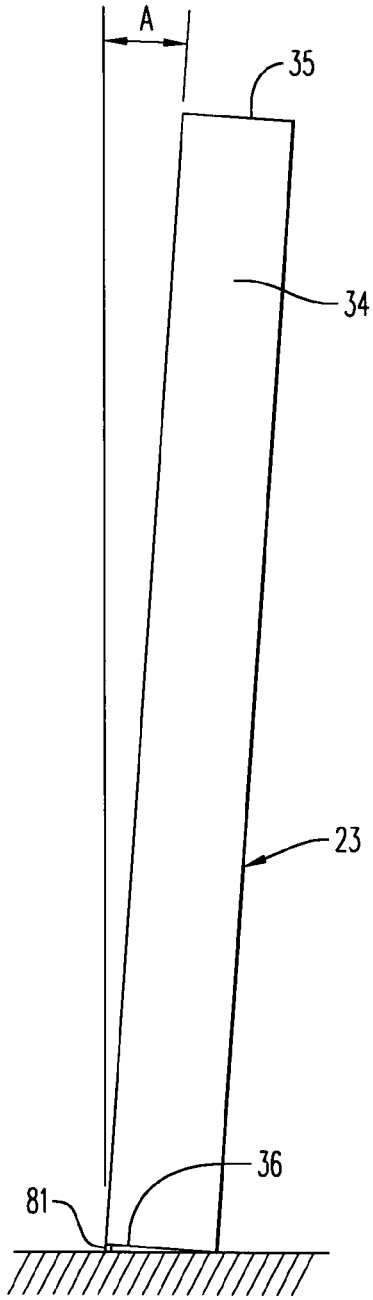
FIG. 12 is a vertically upright position of the packaged instrument of FIGS. 1-3.

As depicted in FIGS. 1-5, a pair of spaced apart tabs 81 project outwardly from the top wall 31 above the flap 36. Another pair of tabs 82 project outwardly from the top wall 31 above the flaps 34. The tabs 81 support the carton 23 in a vertically upright position (FIG. 12) while the tabs 82 support the carton 23 in a horizontally upright position (FIG. 11). In both positions, the top wall 31 of the carton 23 is tilted rearwardly at an angle A to provide stability and more clearly display the guitar 22. In the vertically upright position (FIG. 12), the upper side wall 28 of the carton is above the lower side wall 36 while in the horizontally upright position (FIG. 11), the first side wall 33 is above the second side wall 34.

Obviously, many modifications and variations of the preset invention are possible in light of the above teachings. It is to be understood, therefore, that the invention can be practiced otherwise than as specifically described.

What is claimed is:

1. A packaged musical instrument comprising:

a carton having a top wall, a bottom wall, a first side wall, a second side wall, an upper side wall, and a lower side wall together defining an inner cavity;

a guitar disposed in said cavity and having a body, and a neck joined to said body and terminated with a tuning head portion;

a first insert disposed in said cavity and having one side wall engaging a lower portion of said first side wall, another side wall engaging a lower portion of said second side wall, and an end wall engaging said lower side wall; and said one side wall, said another side wall and said end wall restrain said body within said cavity;

a second insert disposed in said cavity and having one portion engaging an upper portion of said first side wall, another portion engaging an upper portion of said second side wall, and a cross member extending between said one portion and said another portion; and said cross member being shaped and arranged to support said neck; and at least one window defined by said top wall and displaying at least a portion of said guitar and wherein said end wall engages a central portion of said lower side wall, and each of said one and another side walls include an angled section joined to said end wall and being shaped and arranged to engage a curved lower side portion of said body.

2. A packaged musical instrument according to claim 1 including a plurality of tabs projecting outwardly from said top wall and being shaped and arranged to support said carton in a tilted position with said top wall sloping rearwardly and said upper side wall above said lower side wall.

3. A packaged musical instrument according to claim 1 wherein said cross member defines a saddle portion disposed centrally between said first and second side walls, and shaped and arranged to receive and support said neck.

4. A packaged musical instrument according to claim 3 including fastener means for restraining said neck in said saddle.

5. A packaged musical instrument according to claim 4 wherein said one window displays at least a portion of said body, and including another window displaying said tuning head portion of said neck.

6. A packaged musical instrument according to claim 5 wherein said top wall defines a strip portion extending over said cross member and separating said one window from said another window.

7. A packaged musical instrument according to claim 6 including flaps extending transversely downwardly from said top wall and engaging outer surfaces of said first and second side walls, said upper side wall and said lower side wall.

8. A packaged musical instrument according to claim 7 including a plurality of tabs projecting outwardly from said top wall and being shaped and arranged to support said carton in a tilted position with said top wall sloping rearwardly and said another side wall above said one side wall.

9. A packaged musical instrument comprising:

a carton having a top wall, a bottom wall, a first side wall, a second side wall, an upper side wall, and a lower side wall together defining an inner cavity;

a guitar disposed in said cavity and having a body, and a neck joined to said body and terminated with a tuning head portion;

a first insert disposed in said cavity and having one side wall engaging a lower portion of said first side wall, another side wall engaging a lower portion of said second side wall, and an end wall engaging said lower side wall; and said one side wall, said another side wall and said end wall restrain said body within said cavity;

a second insert disposed in said cavity and having one portion engaging an upper portion of said first side wall, another portion engaging an upper portion of said second side wall, and a cross member extending between said one portion and said another portion; and said cross member being shaped and arranged to support said neck; and one window defined by said top wall and displaying at least a portion of said body and another window defined by said top wall and displaying said tuning head portion of said neck, and wherein said top wall defines a strip portion extending over said cross member and separating said one window from said another window.

10. A packaged musical instrument according to claim 9 including a plurality of tabs projecting outwardly from said top wall and being shaped and arranged to support said carton in a tilted position with said top wall sloping rearwardly and said upper side wall above said lower side wall.

11. A packaged musical instrument according to claim 9 wherein said end wall engages a central portion of said lower side wall, and each of said one and another side walls include an angled section joined to said end wall and being shaped and arranged to engage a curved lower side portion of said body.

12. A packaged musical instnaxnent according to claim 11 wherein said cross member defines a saddle portion shaped and arranged to receive and support said neck.

13. A packaged musical instrument according to claim 12 including fastener means for restraining said neck in said saddle.

* * * * *